United States Patent [19]

Lindquist

[11] Patent Number: 4,716,343

[45] Date of Patent: Dec. 29, 1987

[54] CONSTANT ILLUMINATION, REMOTELY DIMMABLE ELECTRONIC BALLAST

[75] Inventor: John Lindquist, Larkspur, Calif.

[73] Assignee: Universal Manufacturing Corporation, Paramus, N.J.

[21] Appl. No.: 798,265

[22] Filed: Nov. 15, 1985

[51] Int. Cl.[4] ..... H05B 37/00

[52] U.S. Cl. ..... 315/307; 315/206; 315/224; 315/DIG. 7

[58] Field of Search ..... 315/307, 224, DIG. 7, 315/206

[56] References Cited

U.S. PATENT DOCUMENTS

| | | | |
|---|---|---|---|
| 3,449,629 | 6/1969 | Wigert | 315/308 |
| 3,611,021 | 10/1971 | Wallace | 315/307 |
| 4,221,994 | 9/1980 | Friedman et al. | 315/224 |
| 4,277,728 | 7/1981 | Stevens | 315/307 |
| 4,585,974 | 4/1986 | Stupp et al. | 315/307 |

*Primary Examiner*—Harold Dixon

*Attorney, Agent, or Firm*—Darby & Darby

[57] ABSTRACT

A solid-state ballast for discharge lamps includes a device for sensing the instantaneous current flowing within the load to produce illumination. A signal representing this load current is differentially processed with an external control signal representing the desired illumination, to produce an removed signal which controls an oscillator that provides the operating signal for the load. In addition, the voltage across the load is sensed and the signal representing this voltage is fed back to a circuit which controls the oscillator so as to limit the maximum load voltage during initial start-up and when a lamp is removed.

17 Claims, 2 Drawing Figures

10
102
V+
T2
51
40
44
42
48
46
24
20
22
26
28
SIGNAL CONTROLLED OSCILLATOR
ONE SHOT 0
25
74
START-UP CONTROL CIRCUIT 100
104
116
114
112
108
110
106
V REF1
V REF 2
83
89
87
85
81
76
84
82
78
80
ILLUMINATION CONTROL CIRCUIT 70
72
EXTERNAL CONTROL SIGNAL

CONSTANT ILLUMINATION, REMOTELY DIMMABLE ELECTRONIC BALLAST

FIELD OF THE INVENTION

The present invention relates generally to an electronic ballast for gas discharge lamps and, more particularly, concerns a high efficiency ballast capable of remote dimming and providing constant illumination over a broad range of environmental and power supply variations.

BACKGROUND OF THE INVENTION

In conventional solid-state ballast for discharge lamps, some form of oscillator or inverter is utilized to drive the load through a power amplifier. It has been found that ambient temperature changes, aging of components, and variations in the impedance of the load produce variations in the drive signal for the load, resulting in variations in the load drive current, and therefore, variations in the illumination provided. Furthermore, it would be desirable to permit variations of illumination under control of an external signal, in order to achieve controlled dimming from a remote location.

Prior to ignition, gas discharge lamps present a substantially higher impedance to the drive circuits than they do during steady-state operation. The removal of one or more lamps from the ballast would similarly result in an increased impedance level. Such high impedance levels could result in the production of dangerously high voltages within the electronic ballast. Such voltages could result in breakdown and destruction of solid-state components, or the electrocution of an individual attempting to change a lamp.

It is an object of the present invention to provide constant current to the load in a solid-state ballast for discharge lamps, independently of ambient temperature variations, component aging, power supply variations, variations in the impedance of the load, and the like.

It is a further object of the present invention to control reliably and conveniently the illumination produced by a solid-state and ballast, from a point remote from the ballast.

It is another object of the present invention to avoid excessively high voltages when a lamp is removed from the ballast, or during start-up, prior to the firing of the lamps.

It is also an object of the present invention to provide a solid-state ballast which is reliable and convenient in use, yet relatively simple and inexpensive in construction.

In accordance with an illustrative embodiment demonstrating objects and features of the present invention, a solid-state ballast for discharge lamps includes a device for sensing the instantaneous current flowing within the load to produce illumination. A signal representing this load current is differentially processed with an external control signal representing the desired illumination, to produce an error signal which controls an oscillator that provides the operating signal for the load. This feedback arrangement results in constant illumination, while also permitting remote dimming control. In addition, the voltage across the load is sensed and the signal representing this voltage is fed back to a circuit which controls the oscillator so as to limit the maximum load voltage during initial start-up and when a lamp is removed.

BRIEF DESCRIPTION OF THE DRAWING

The foregoing brief description, as well as further objects, features, and advantages of the present invention will best be understood from the following description of a presently preferred, but nonetheless illustrative, embodiment of the present invention, with reference being had to the drawing, wherein.

DETAILED DESCRIPTION OF THE PREFERRED EMBODIMENT

Figure 1:
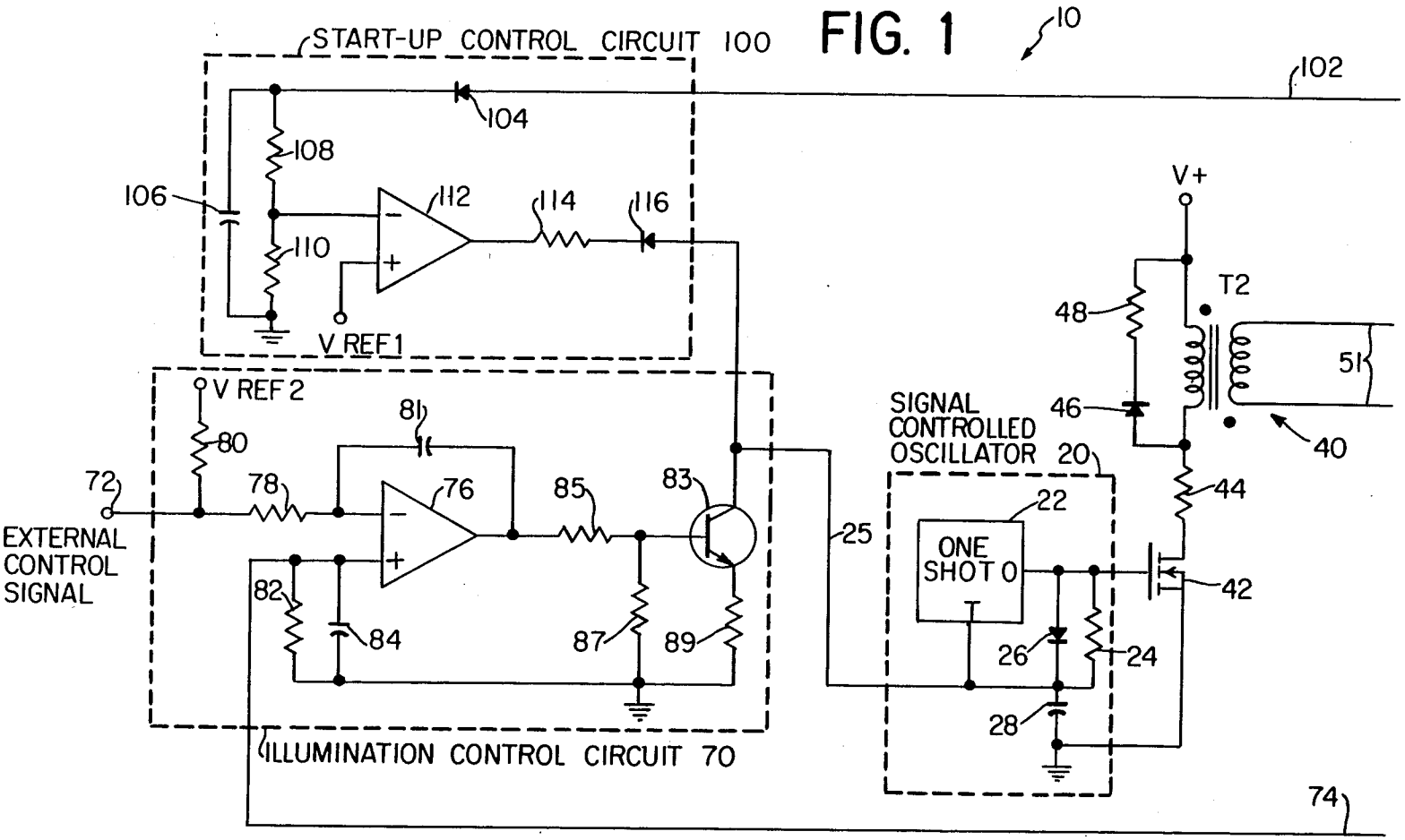
FIGS. 1 and 2, in combination, comprise a schematic circuit diagram of a solid-state ballast incorporating the present invention.
Figure 2:
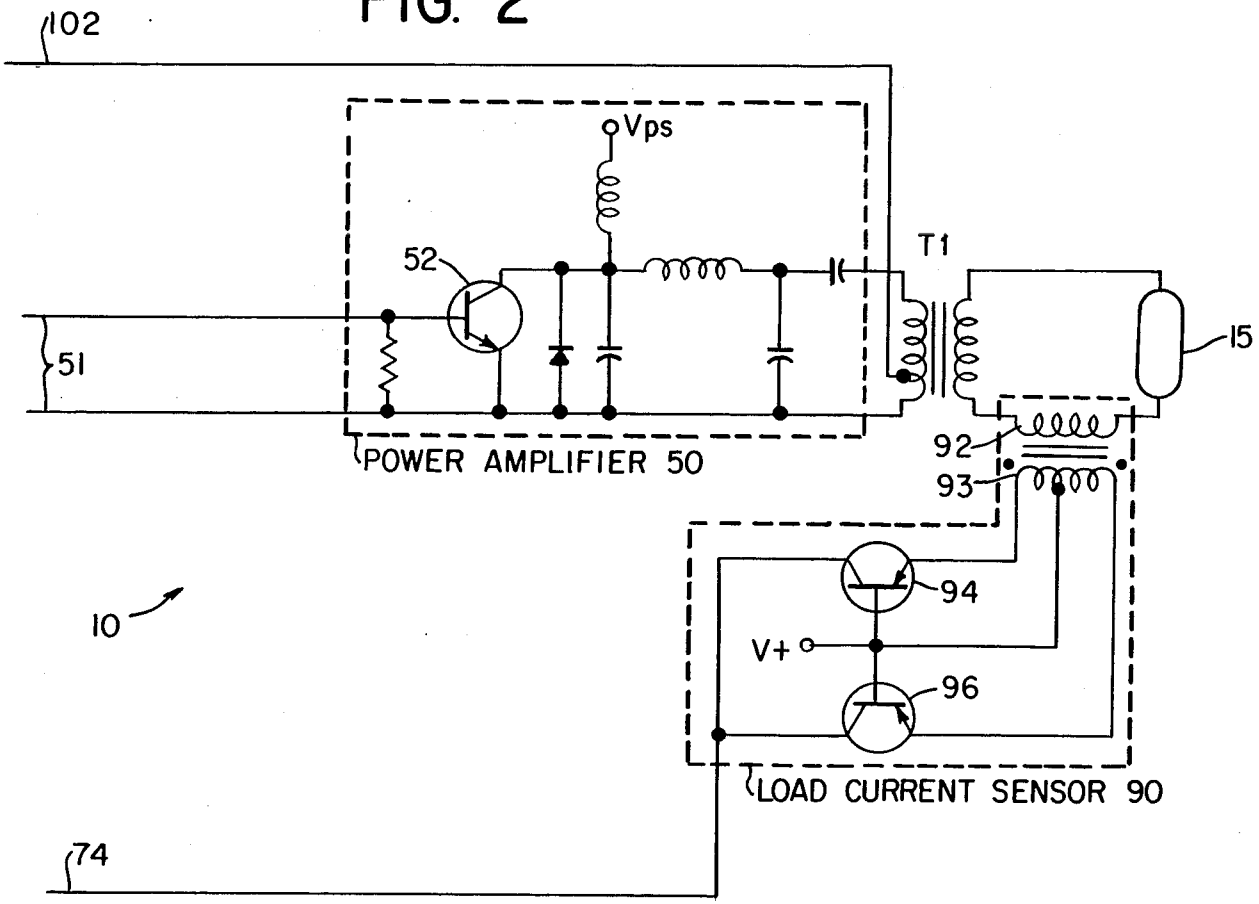

Turning now to the details of the drawing, FIGS. 1 and 2 together comprise a simplified circuit schematic diagram of a preferred embodiment of the invention incorporated in an electronic ballast, 10, for discharge lamps. In FIG. 1, the details of all DC power supplies have been omitted, it being assumed that some conventional form of well-regulated power supply would be employed and would be used not only to provide operating drive current for the load, but also to derive voltage levels for operating the electronics. Preferably, the power supply would derive its energy from the AC power line.

The electronic balast 10 broadly comprises: a signal controlled oscillator 20 providing a nominal operating signal of about 30 kHz; a drive circuit 40 coupling the oscillator signal to a resonant power amplifier 50 which is coupled, through a transformer T1, to a load 15 comprising one of more gas discharge lamps; an illumination control circuit 70 responsive to an external control signal to control the frequency of signal controlled oscillator 20; a load current sensor 90, which is feedback coupled to illumination control circuit 70; and a start-up control circuit 100, which is coupled to regulate signal controlled oscillator 20, under feedback control from transformer T1.

In operation, signal controlled oscillator 20 provides a high frequency signal to drive the load 15 via power amplifier 50 through transformer T1. During initial start-up and when one or more lamps are removed, start-up control circuit 100 acts on signal controlled oscillator 20 to modify its frequency so that the voltage presented to the load is maintained below a predetermined open-circuit voltage level. After all the lamps in the load have been ignited, start-up control circuit 100 remains inactive, unless a lamp is removed. During normal operation, illumination control circuit 70 controls the frequency of signal controlled oscillator 20 and, therefore, the amount of current provided to the load. This load current is sensed by load current sensor 90, which provides a feedback signal to illumination control circuit 70. This results in a load current feedback control loop, which maintains the load current under close regulation. The actual value of the load current, and therefore the brightness of the illumination produced by the lamps in the load, can be regulated by an external control signal applied to illumination control circuit 70.

Signal controlled oscilllator 20 includes a "one-shot" circuit 22, a resistor 24, a diode 26, and a capacitor 28. It is characteristic of the one-shot circuit that it will produce a positive pulse of predetermined duration at its output O, upon being triggered with a sufficiently negative voltage level applied to its trigger input T. The diode 26 is connected in a foward direction between the output and trigger input of one-shot 22, and the resistor 24 is connected in parallel across the diode. The capacitor 28 is connected between the trigger input of one-shot 22 and ground. In addition, signals external to signal controlled oscillator 20 may be applied to the trigger input of one-shot 22 via lead 25.

In operation, diode 26 turns on whenever one-shot 22 produces a pulse, whereby capacitor 28 is rapidly charged to the peak level of the pulse. When the pulse of one-shot 22 terminates, diode 26 turns off and capacitor 28 begins to discharge through resistor 24. When the voltage across capacitor 28 reaches the threshold level of one-shot 22, the one-shot is retriggered. The delay between the termination of the pulse at the output of one-shot 22 and the re-triggering of the one-shot is determined by the values of resistor 24 and capacitor 28, as well as any external signals applied to lead 25. By selecting the values of resistor 24 and capacitor 28 and controlling the current flow in lead 25, it is possible to control precisely the re-triggering delay of one-shot 22. Since the output pulse duration of the one-shot is known, this will result in precise control of the output frequency of signal controlled oscillator 20.

One-shot 22 is preferably realized with a conventional timer circuit, such as an RCA CA555 timer. A one-shot circuit is a convention configuration for such a timer.

Driver 40 is a conventional "flyback" circuit. It includes a field effect transistor 42 acting as a switch, a current limiting resistor 44 connected in series with the primary of a transformer T2, and a diode 46 connected in series with a resistor 48 across the primary of the transformer. The secondary of the transformer is wound so that it produces a signal reversal with respect to the primary.

In operation, transistor 42 is turned on by each pulse at the output of signal controlled oscillator 20, and it turns off when the pulse terminates. As a result of the signal inversion produced at the secondary of the transformer, when transistor 42 turns on, transistor 52 is turned off. Transistor 42 continues to draw current through the primary of T2 until it is turned off by oscillator 20. Then, the current drawn through the primary of T2 decreases rapidly, inducing a voltage in the secondary which turns on transistor 52. The value of resistor 44 determines the current flow in transistor 42, diode 46 prevents excessively large transients at the drain of transistor 42, which could damage the transistor, and resistor 48 limits the current flow in diode 46.

Power amplifier 50 is a known type of tuned, switching power amplifier described in "Class E—A New Class of High-efficiency Tuned Single-ended Switching Power Amplifiers", Nathan O. Sokal, et al., Vol. SC-10, No. 3, IEEE Journal of Solidstate Circuits (June 1975). This amplifier is designed to operate resonantly in such a manner that the collector current of transistor 52 is minimal when the collector-to-emitter voltage is non-zero, and so that the collector-to-emitter voltage is minimal when collector current flows. By design, the resonant frequency of the amplifier corresponds to the nominal frequency of signal controlled oscillator 20.

Illumination control circuit 70 receives an external control signal via lead 72. Circuit 70 also receives a current control signal which is fed back via lead 74 from load current sensor 90. Within illumination control circuit 70, the external control signal is fed to the inverting input of a differential input operational amplifier 76 through a resistor 78. In addition, an internally generated reference voltage $V_{REF2}$ is applied to the inverting input of amplifier 76 via resistors 80 and 78. The signal fed back via lead 74 from load current sensor 90 is applied to the non-inverting input of amplifier 76, and the resistor 82 and capacitor 84 are connected between the non-inverting input and ground. The output of amplifier 76 is fed back to the inverting input through a capacitor 81, and is also applied to the base of a transistor 83 through a resistor divider 85, 87. The emitter of transistor 83 is connected to ground through a current-determining resistor 89, and the collector of the transistor is connected to signal controlled oscillator 20 via lead 25.

In operation, $V_{REF2}$ is utilized to maintain the illumination of the load at a predetermined level, in the absence of an external control signal. This predetermined level of illumination can be modified by applying an external control signal to lead 72, preferably in the form of a pulse width modulated signal. The value of capacitor 81 is selected so as to provide a filtering effect with respect to the pulse width modulated signal on lead 72, whereby the signal at the inverting input of amplifier 76 is a weighted sum of $V_{REF2}$ and the DC level of the external control signal.

The current feedback signal on lead 74 produces a voltage at the non-inverting input of amplifier 76, the amplitude of which depends upon the amplitude of the output current provided to the load. Capacitor 84 averages the signal from load current sensor 90, to produce a d.c. voltage. As is wellknown, the overall effect of the feedback loop will be to make the voltages on the inverting and non-inverting inputs of amplifier 76 equal. As will be understood from the discussion which follws, this has the effect of maintaining the load current constant in amplitude.

Should the voltage at the non-inverting input of amplifier 76 momentarily exceed the voltage at the inverting input, an error voltage would be produced at the output of the amplifier, which would be fed, in attenuated form, to the base of transistor 83. This produces a current in the emitter of transistor 83, the value of which is determined by the value of resistor 89. This same current is drawn by the collector of transistor 83 from the lead 25. In signal controlled oscillator 20, the current drawn by the collector of transistor 83 from the lead 25 contributes to the rate at which capacitor 28 is discharged. The overall effect is to shorten the duration of a cycle of signal controlled oscillator 20, therby increasing its frequency. This frequency shift causes the oscillator signal to move beyond the center of the resonance band of power amplifier 50, whereby the amplitude of the signal driving the load 15 is reduced. From this description, it will be clear that the feedback loop compensates for changes in the drive signal to the load, thereby maintaining the current supplied to it, and therefore the illumination, constant.

Load current sensor 90 includes a transformer T3 having a primary winding 92, through which the load current flows. The secondary winding 93 of transformer T3 has a current induced in it which is proportional to the current in primary 92. The secondary 93 of transformer T3 has a center tap which is connected to the bases of transistors 94 and 96 to the power supply V+ for the electronics. The opposite ends of secondary 93 are connected to the emitters of transistors 94 and 96, respectively.

By design, the load current is essentially sinusoidal, as a result of the resonant operation of power amplifier 50. The two halves of secondary 93 are oppositely poled and each drives the emitter of a common base transistor. Hence, transistors 94 and 96 will respond to opposite half-cycles of the load current. Owing to the high impedance levels present at the collectors of tranistors 94 and 96, these collectors appear essentially as current sources. By connecting the two collectors together, their currents are combined, and a composite current source is obtained which provides a current, on lead 74, which is a full-wave rectified replica of the load current. As explained above, this current is utilized in illumination control circuit 70 to achieve feedback control by smoothing the rectified signal to produce a D.C. voltage.

Via a tap on the primary of transistors T1, a portion of the load voltage is fed back to start-up control circuit 100 via lead 102. Within circuit 100, this signal is applied through a diode 104 and a capacitor 106 to ground. The combination of the diode and capacitor is a peak detector, so that a voltage appears across the capacitor 106 which is proportional to the peak value of the drive voltage on transformer T1. A portion of this voltage is fed via a resistor divider 108, 110 to the inverting input of a differential operational amplifier 112. The noninverting input of amplifier 112 is connected to an internally generated reference voltage $V_{REF1}$, and the output of the amplifier is coupled through a resistor 114 and diode 116 to lead 25.

In operation, the output of amplifier 112 is maintained at a high level, unless the voltage at the inverting input exceeds $V_{REF1}$. This will occur only prior to the ignition of the lamp(s) comprising the load or if one or more lamps are removed. When the voltage at the inverting input does exceed $V_{REF1}$, the output of amplifier 112 is driven low, diode 116 is turned on, and this low level is coupled to lead 25. This results in rapid discharge of capacitor 28 in signal controlled oscillator 20, whereby the operating frequency of the oscillator is substantially increased. Through the feedback loop including control circuit 100, the voltage applied to the load is reduced to a safe level, at which transistor 52 is not in danger of being damaged. Furthermore, under open circuit conditions, the output voltage is maintained at level sufficient to ionize lamps.

Although a preferred embodiment of the invention has been disclosed for illustrative purposes, those skilled in the art will appreciate that many additions, modifications, and substitutions are possible, without departing from the scope and spirit of the invention as defined by the accompanying claims.

What is claimed is:

1. In a solid-state ballast for discharge lamps, the ballast being of the type including an oscillator providing an operating signal to the discharge lamp load through a driver, the improvement comprising:

said oscillator being a signal controlled oscillator having a frequency control input and providing an output signal with a frequency determined by the value of a signal applied at said frequency control input, wherein said signal controlled oscillator comprises:

a one-shot circuit having an output providing a pulse of predetermined duration and an input for triggering the initiation of said pulse;

delay means connecting said output of said one-shot to the input thereof; and means coupling said one-shot output as the output signal of said oscillator;

means sensing the instantaneous current flowing within the load for producing a control signal representing this load current; and means for coupling said control signal to said frequency control input.

2. A ballast in accordance with claim 1, wherein said coupling means comprises:

means jointly responsive to said control signal and an externally provided brightness level signal for differentially processing said signals to produce an error signal; and means for providing said error signal to said frequency control input.

3. A ballast in accordance with claim 1, wherein said delay means comprises a capacitor and a resistor connected in series circuit between said one-shot output and a voltage source, a diode connected in parallel circuit with said resistor, and means connecting the junction of said resistor and said capacitor to said one-shot input.

4. A ballast in accordance with claim 2, wherein said means for differentially processing comprises a differential amplifier having said said brightness level signal applied to the noninverting input and the control signal to the inverting input.

5. A ballast in accordance with claim 2, further comprising means for generating a brightness reference voltage and means for forming a weighted average between said brightness reference voltage and said brightness level signal, said means for differentially processing being a differential amplifier having said said weighted average applied to the noninverting input and the control signal to the inverting input.

6. A ballast in accordance with claim 1, further comprising means for coupling the voltage across said load to said frequency control input.

7. A ballast in accordance with claim 1, wherein said means for producing a control signal comprises means for generating a full-wave rectified replica of said load current.

8. In a solid-state ballast for discharge lamps, the ballast being of the type including an oscillator providing an operating signal to the discharge lamp load through a driver, the improvement comprising:

said oscillator being a signal controlled oscillator having a frequency control input and providing an output signal with a frequency determined by the value of a signal applied at said frequency control input;

means sensing the instantaneous current flowing within the load for producing a control signal representing this load current, comprising:

a transformer having a primary winding in series circuit with said load and a secondary winding which is centertapped, the two parts of said secondary being wound so as to be oppositely poled; and first and second transistors with the base of the first transistor connected to the base of the second transistor and the collector of the first transistor connected to the collector of the second transistor, the emitters thereof being connected to opposite ends of said secondary winding, said interconnected bases being also connected to said center tap and a voltage source, said control signal being produced at said interconnected collectors; and means for coupling said control signal to said frequency control input.

9. A ballast in accordance with claim 8, wherein said action signal is coupled to said frequency control input through a diode.

10. A ballast in accordance with claim 7, further comprising means for coupling the voltage across said load to said frequency control input.

11. A ballast in accordance with claim 10, wherein said voltage coupling means comprises means for peak detecting the load voltage and means differentially responsive to said peak detected voltage and an action signal coupled to said frequency control input.

12. A ballast in accordance with claim 11, wherein said action signal is coupled to said frequency control input through a diode.

13. A ballast in accordance with claim 7, wherein said voltage coupling means comprises means for peak detecting the load voltage and means differentially responsive to said peak detected voltage and an action signal coupled to said frequency control input.

14. In a solid-state ballast for discharge lamps, the ballast being of the type including an oscillator providing an operating signal to the discharge lamp load through a driver, the improvement comprising:

said oscillator being a signal controlled oscillator having a frequency control input and providing an output signal with a frequency determined by the value of a signal applied at said frequency control input;

a transformer having a primary winding in series circuit with said load and a secondary winding which is centertapped, the two parts of said secondary being wound so as to be oppositely poled;

first and second transistors with the base of the first transistor connected to the base of the second transistor and the collector of the first transistor connected to the collector of the second transistor, the emitters thereof being connected to opposite ends of said secondary winding, said interconnected bases being also connected to said center tap and a voltage source, said control signal being produced at said interconnected collectors;

means jointly responsive to said control signal and a brightness level signal generated externally of said ballast at a point remote therefrom for differentially processing said signals to produce an error signal; and means for providing said error signal to said frequency control input.

15. A ballast in accordance with claim 1, wherein said means for differentially processing comprises a differential amplifier having said brightness level signal applied to the noninverting input and the control signal to the inverting input.

16. A ballast in accordance with claim 1, further comprising means for generating a brightness reference voltage and means for forming a weighted average between said brightness reference voltage and said brightness level signal, said means for differentially processing being a differential amplifier having said weighted average applied to the noninverting input and the control signal to the inverting input.

17. A ballast in accordance with claim 1, wherein said means for producing a control signal comprises means for generating a full-wave rectified replica of said load current.

* * * * *